US005941738A

United States Patent [19]

Matsunaga et al.

[11] Patent Number: 5,941,738

[45] Date of Patent: Aug. 24, 1999

[54] BATTERY TERMINAL

[75] Inventors: Hideki Matsunaga; Keigo Atsumi, both of Yokkaichi, Japan

[73] Assignee: Sumitomo Wiring Systems, Ltd., Japan

[21] Appl. No.: 09/121,034

[22] Filed: Jul. 23, 1998

[30] Foreign Application Priority Data

Jul. 31, 1997 [JP] Japan ..... 9-206757

[51] Int. Cl.[6] ..... H01R 4/42

[52] U.S. Cl. ..... 439/762; 439/763

[58] Field of Search ..... 439/762, 763, 439/764, 765, 761

[56] References Cited

U.S. PATENT DOCUMENTS

| | | | |
|---|---|---|---|
| 4,063,794 | 12/1977 | Dittmann . | |
| 5,087,214 | 2/1992 | Dewar | 439/762 |
| 5,498,178 | 3/1996 | Tabata | 439/762 |
| 5,558,545 | 9/1996 | Staab et al. | 439/762 |
| 5,707,257 | 1/1998 | Kotajima et al. | 439/762 |
| 5,711,688 | 1/1998 | Matsunaga et al. | 439/762 |

FOREIGN PATENT DOCUMENTS 8-315889 11/1996 Japan .

*Primary Examiner*—Steven L. Stephan
*Assistant Examiner*—Chandrika Prasad
*Attorney, Agent, or Firm*—Banner & Witcoff, Ltd.

[57] ABSTRACT

A battery terminal 10 is provided with a substantially circular electrode supporting member 11, which fits onto a frusto-conical electrode P of a battery, and a pair of mutually facing foot members 14,15 extending outwards from both ends of the electrode supporting member 11. Strengthening members 22,30 extend along the foot members 14,15 and along one quarter circle of the electrode supporting member 11 from the foot members 14,15. These cause the second moment of inertia of the foot members 14,15 and of the electrode supporting member 11 to be different. As a result, the diameter of the electrode supporting member 11 can be reduced without the foot members 14,15 changing shape. If a bolt 18 passing through the foot members 14,15 is tightened to a specific extent with a torque wrench, the battery terminal 10 can be attached to the electrode P with a desired tightening force.

10 Claims, 4 Drawing Sheets

BATTERY TERMINAL

FIELD OF INDUSTRIAL APPLICATION

The present invention relates to a battery terminal used for connecting electric wires to electrodes of a battery provided on an automobile or the like.

PRIOR ART

A conventional battery terminal is shown in FIG. 4. The battery terminal comprises an electrode supporting member 1 made from a metal sheet bent into a circular shape. A pair of mutually facing foot members 2 protrude from the two ends of the electrode supporting member 1, with holes 3 passing through the foot members 2. After the electrode supporting member 1 has been fitted to an electrode P of a battery B, a bolt 4 is inserted through the holes 3 and a nut 5 is threaded onto the bolt 4 and is tightened, thus bringing the two foot members 2 together and reducing the diameter of the electrode supporting member 1. As a result, the electrode supporting member 1 is pushed onto the outer peripheral face of the electrode P, and the electrode supporting member 1 and the electrode P are connected.

PROBLEM TO BE SOLVED BY THE INVENTION

However, since the battery terminal described above comprises a metal sheet which has been bent, the second moment of inertia of the foot members 2 and the electrode supporting member 1 is identical. Consequently, if a pushing force is exerted on the electrode supporting member 1 before it is connected to the electrode P, it is possible that the foot members 2 may bend and change shape. As a result, the connection between the electrode supporting member 1 and the electrode P may be inadequate. Further, battery terminals of the type described in Laid-Open Provisional Publication No.315889/97 (see FIG. 5) are strengthened overall by being provided with strengthening ribs 6 on both edges in a wide-wise direction and along the entire length of the metal sheet. However, it has been found that the electrode supporting member 1 is difficult to bend, and thus causes the strengthening ribs 6 to develop cracks.

The present invention has been developed after taking the above problem into consideration, and aims to present a battery terminal which is reliably attachable to the electrode of the battery.

SUMMARY OF THE INVENTION

According to the present invention there is provided a battery terminal connector 10 suitable for connection to a substantially circular battery post P, the connector being formed from a strip of conductive material and including a mid portion 11 adapted to fit the post P, the mid portion 11 having arms 14,15 extending therefrom which, in use, are movable together so as to render said mid portion 11 substantially circular and thereby clamp the connector 11 to the post P, characterised in that the mid portion 11 is provided with a strengthening member 22,30 which extends from an arm 14,15 partially therealong to define a preferred bending region.

The present invention thus provides a connector having an unstrengthened section which is easily bendable, and a strengthened section which is resistant to bending. In a preferred embodiment the strengthening member overlaps the interface between the mid portion and an arm. Consequently, when the arms are moved together, it is the unstrengthened section of the mid portion which bends, while arms are prevented from bending relative to the mid portion.

The strengthening members may comprise ribs or flanged edges of the strip. The ribs may be formed by pressing or stamping the strip. In a preferred embodiment the arms are provided with aligned apertures, and are movable together, in use, by a screw threaded fastener passing therethrough, and the strengthening member is adapted to prevent the head of the screw threaded fastener from rotating.

The inner face of the preferred bending region may be formed so as to interengage with the battery post. Accordingly said inner face may be provided with equidistantly spaced recesses, grooves or ribs which are adapted to engage the surface of the battery post.

Embodiments of the present invention will now be described with reference to the accompanying figures in which.

Figure 1:
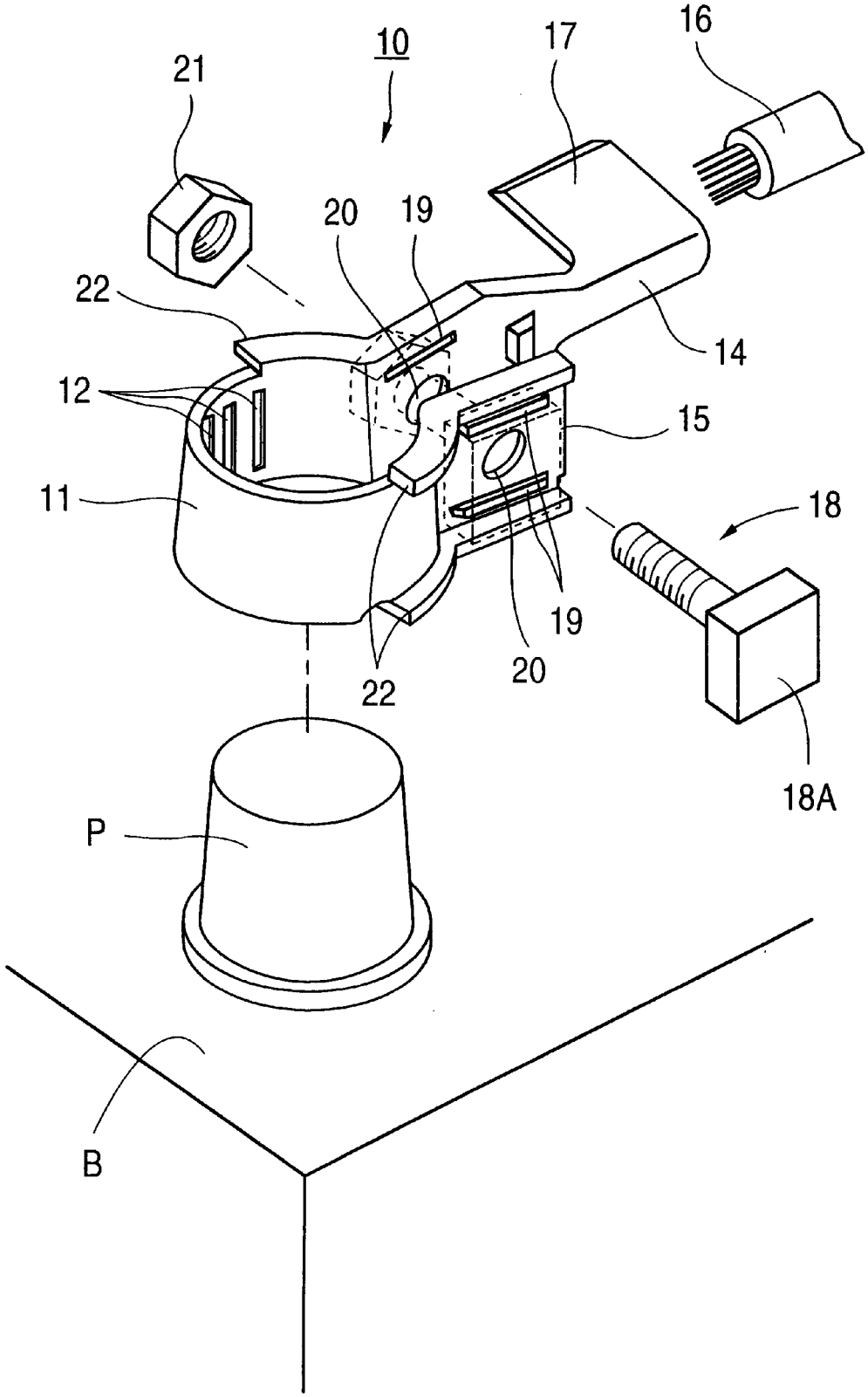
FIG. 1 shows a diagonal view of a battery terminal according to a first embodiment of the present invention.

A first embodiment of the present invention is explained below with the aid of FIGS. 1 and 2.

The symbol P in the diagram refers to an electrode, commonly referred to as a "post", which protrudes from a battery B suitable for automobiles or the like. This electrode P is typically made from lead and is frusto-conical. The symbol 10 refers to the battery terminal in the present embodiment, this battery terminal 10 being provided with a substantially circular electrode supporting member 11 that fits with the electrode P.

The electrode supporting member 11 is formed from a strip of a thin electrically conductive metal plate. The strip is bent to define a circular shaped central portion with two planar foot members 14,15. The central portion is also frusto-conical and corresponds substantially to the shape of the electrode P. In its unattached state, the electrode supporting member 11 has a diameter greater than that of the electrode P, allowing the electrode supporting member to be fitted to the electrode P. In use, the two foot members 14 and 15 are brought closer together to cause the diameter of the electrode supporting member 11 to be reduced in a resilient manner.

The inner peripheral face of the electrode supporting member 11 has a plurality of equi-distantly spaced vertical cut-away grooves 12 , the function of which is to cut into the outer peripheral face of the electrode P. It will be noted that the upper and lower edges of these grooves 12 do not extend to the upper and lower edges of the electrode supporting member 11, and this serves to prevent the electrode supporting member 11 from easily changing shape, and prevents the interior edges of the grooves 12 from becoming weaker and from easily developing cracks. In an alternative embodiment the inner peripheral face may be provided with raised projections or ribs.

The foot members 14,15 protrude from the ends of the circular central portion. A crimping barrel 17 is formed on a protruding edge of one of the foot members 14 to allow an end of an electric wire 16 to be connected to the battery terminal 10. The foot members 14,15 are provided with mutually corresponding bolt holes 20 which allow the passage of a tightening bolt 18 therethrough. Adjacent the bolt holes 20 of the foot members 14,15 there are provided raised seat protrusions 19 for a bolt head 18A and a nut 21, these protrusions 19 being formed by a pressing process. These seat protrusions 19 extend in a longitudinal direction along the foot members 14,15 on either side of the bolt holes 20 and also serve as ribs to increase the bending strength of the foot members 14,15. In addition, the bolt 18 used in the present embodiment has a square head 18A in order to over-lie the seat protrusions 19.

On the upper and lower edges of the battery terminal 10, lateral strengthening ribs 22 according to the present invention protrude outwards from the edges of the electrode supporting member 11 and the foot members 14,15. The strengthening ribs 22 are formed in the following manner. When the metal strip is cut from the thin metal sheet, side portions corresponding to the strengthening ribs 22 of the metal strip are provided in advance as bending members. The side portions are then bent at right angles to the main body of the strip, and as a result, define the foot members 14,15 from the electrode supporting member 11. The strengthening ribs 22 each extend around approximately one quarter of the circular central portion of the electrode supporting member 11 and along the full length of the foot members 14,15. As a result of this, the second moment of inertia of portion of the battery terminal 10 having the strengthening ribs 22 is greater than that of the remaining portion.

Figure 2:
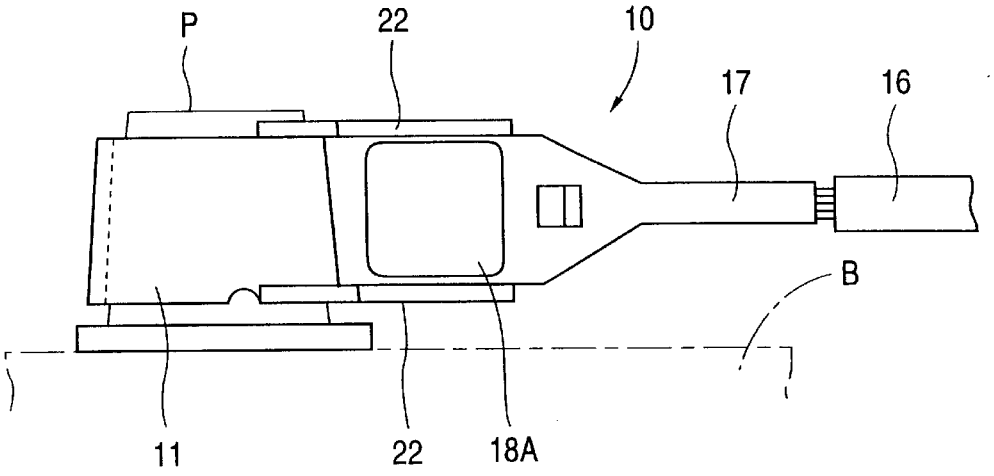
FIG. 2 shows a side view of the battery terminal of FIG. 1.

Furthermore, as shown in FIG. 2, the distance between the upper and lower strengthening ribs 22 of the present embodiment is sized to allow the insertion of a bolt head 18A, thus locking the bolt head 18A in place and preventing it from rotating.

Next, the operation and effects of the present embodiment will be explained. When the battery terminal 10 is to be fitted to the electrode P of the battery B, the electrode supporting member 11 is fitted to the electrode P and a torque wrench is used to tighten the nut 21. At this point, the bolt head 18A is located between the strengthening ribs 22, allowing the tightening operation to be performed quite easily. This tightening exerts a force on the foot members 14,15 in a direction that brings them closer together. Since the strengthening ribs 22 do not extend over the entire battery terminal 10, differing portions of the battery terminal 10 differ in their bending characteristics. As a result, there are portions which chiefly bend as a result of the aforementioned tightening force and portions which transmit force while being resistant to bending. Since the strengthening ribs 22 are provided on the foot members 14,15 and on adjacent quarters of the circular central portion contiguous with the foot members 14,15, this strengthened portion can transmit force with very little bending or changing of shape. Moreover, since the strengthening ribs 22 are contiguous to the electrode supporting member 11 and the foot members 14,15, the angle of the foot members 14,15 relative to the circular central portion electrode supporting member 11, does not change. As there are no strengthening ribs 22 on the remaining semi-circular portion of the electrode supporting member 11 away from the foot members 14,15, and the bending moment is therefore greater farthest from the point of leverage, the unstrengthened portion of the electrode supporting member 11 is able to bend and to clamp onto the electrode P. The diameter of this semicircular portion is further able to reduce after it contacts the outer periphery of the electrode P as the cut-away grooves 12 on the inner periphery of the electrode supporting member 11 cut into the outer peripheral face of the electrode P, and thus strengthen the attachment.

In this manner, according to the present embodiment, the second moment of inertia of the foot members 14,15 and of the electrode supporting member 11 are different. As a result, the foot member 14,15 are resistant to changes in shape as the diameter of the electrode supporting member 11 is reduced, and therefore the battery terminal 10 is clamped onto the electrode P with adequate force and reliability of the electrical connection between the electrode and the battery terminal 10 is improved.

Figure 3:
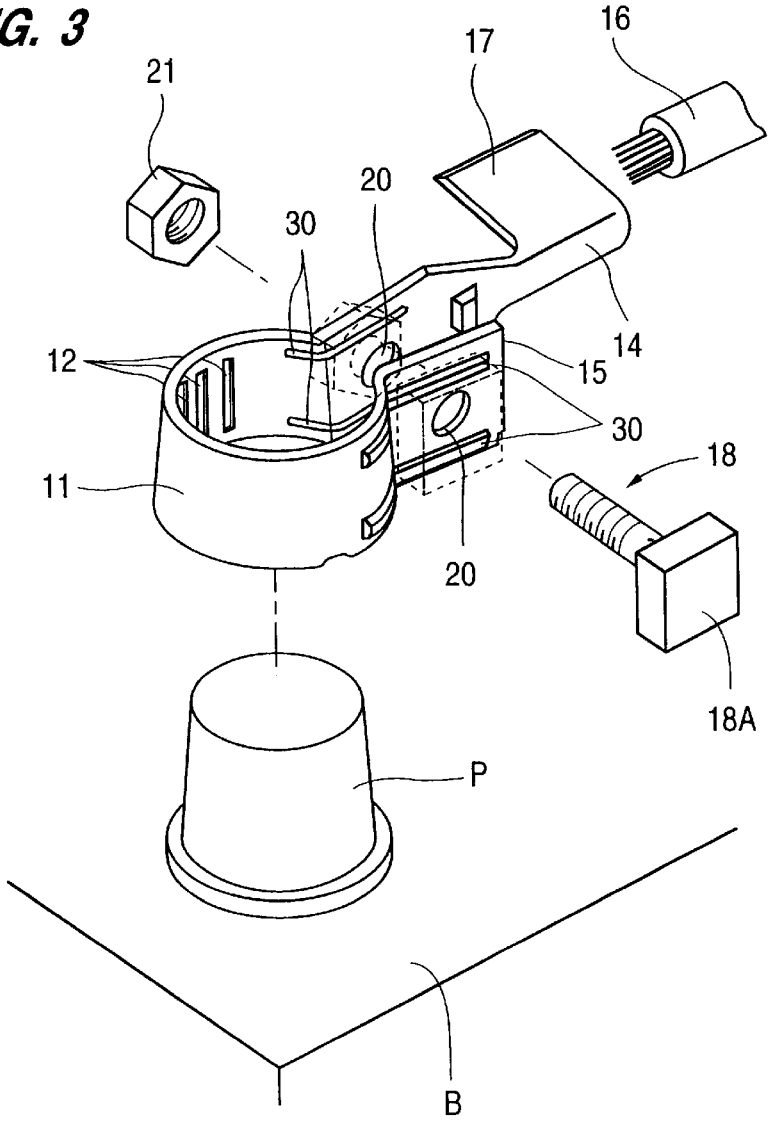
FIG. 3 shows a diagonal view of a battery terminal according to a second embodiment of the present invention.
Figure 4:
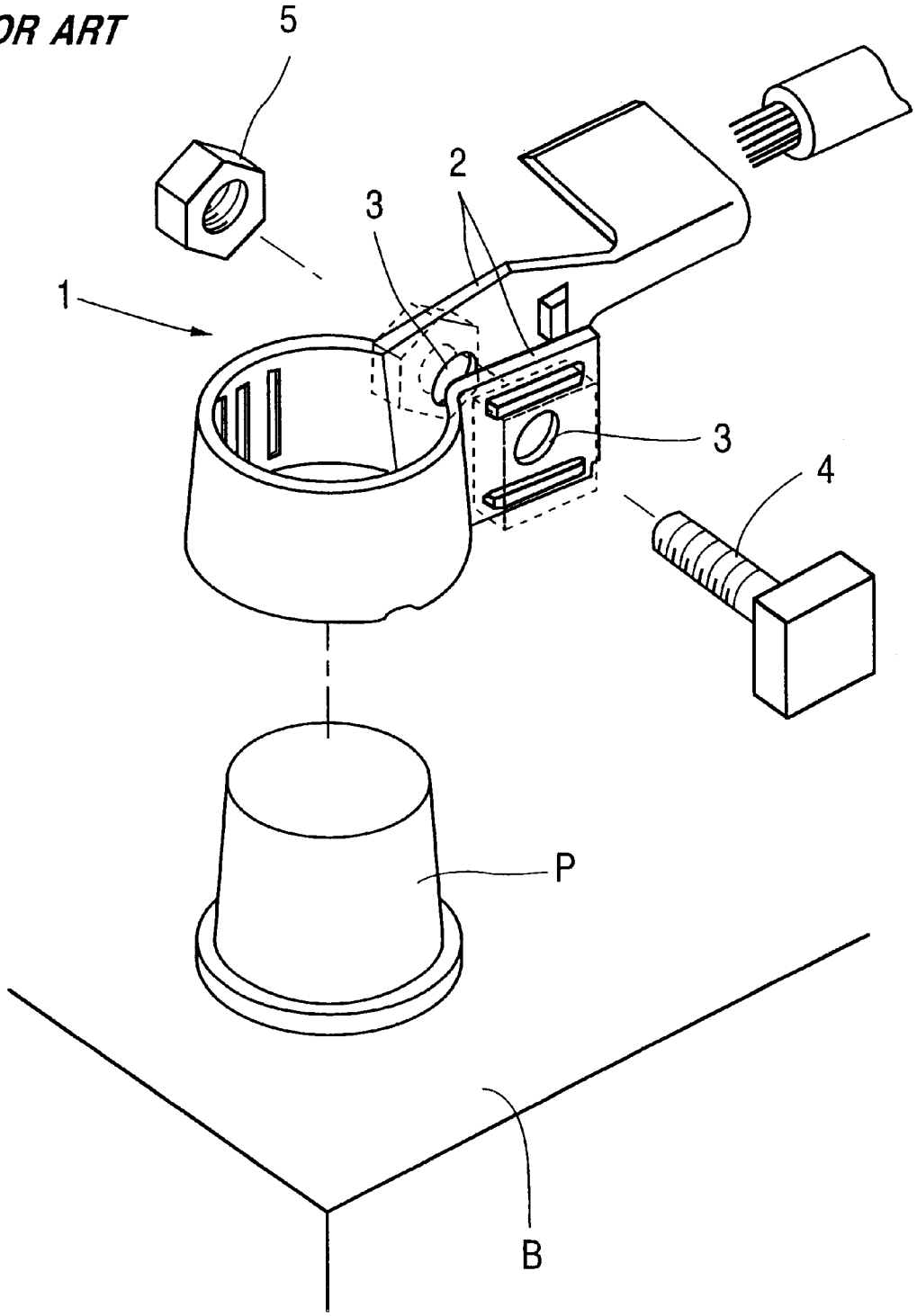
FIG. 4 PRIOR ART
FIG. 4 shows a diagonal view of a conventional battery terminal.
Figure 5:
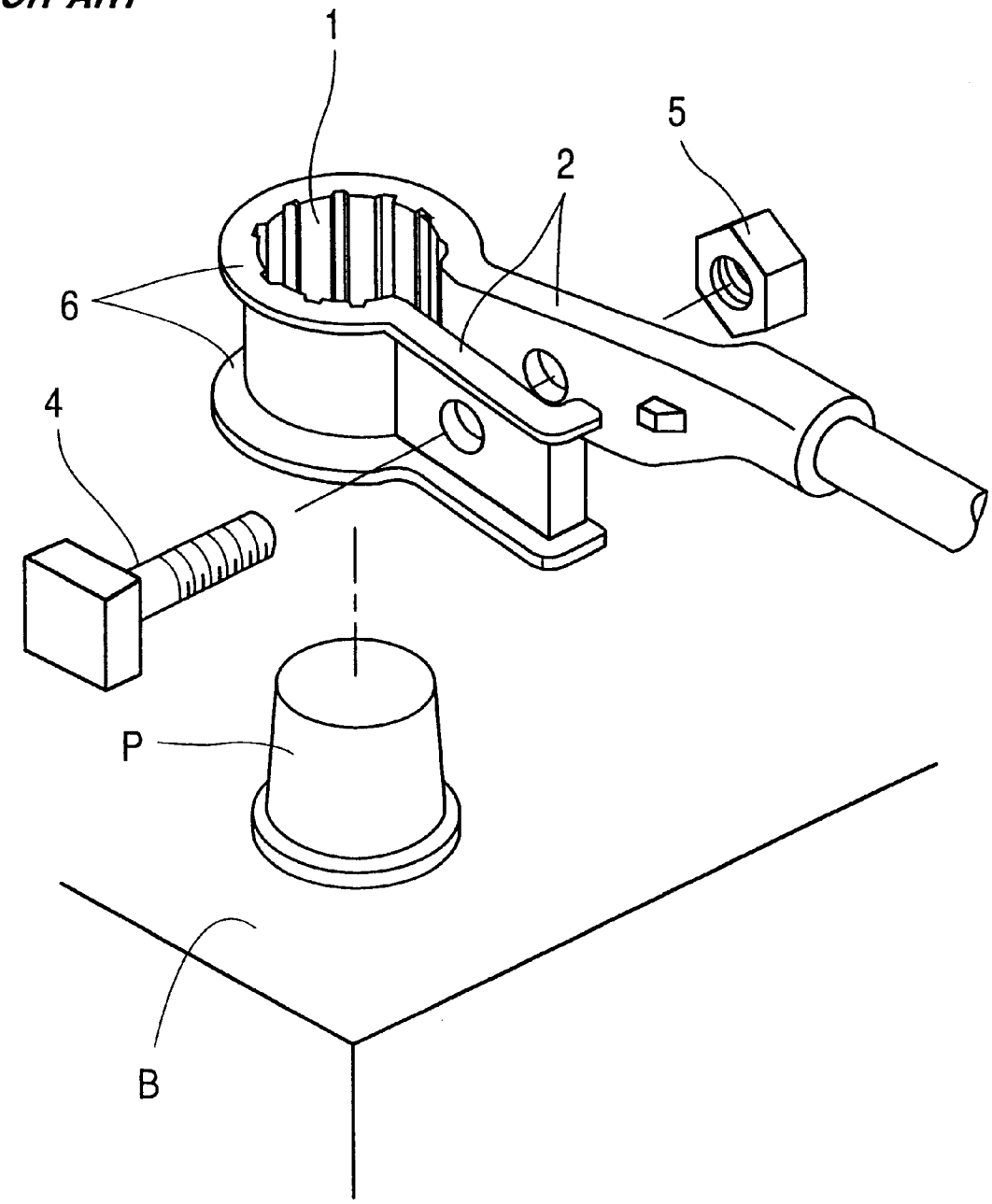
FIG. 5 PRIOR ART
FIG. 5 shows a diagonal view of a different conventional battery terminal.

FIG. 3 shows an alternative embodiment of the present invention whereby strengthening ribs 30 are formed adjacent the bolt holes 20 of the foot members 14,15.

The strengthening ribs 30 are formed by pressing out portions of the thin metal sheet from which the terminal 10 is formed. The strengthening ribs correspond substantially to the seat protrusions of the previously described embodiment which have been extended to and around the electrode supporting member 11. The use of such pressed out strengthening ribs 30 simplifies the production of the battery terminal 10 as they can be formed by a single stamping operation at the same time as the cut-away grooves 12.

Furthermore, the present invention is not limited to the embodiments described above. For example, the possibilities described below also lie within the technical range of the present invention. In addition, the present invention may be embodied in various other ways without deviating from the scope thereof.

(1) In the first embodiment, strengthening ribs 22 are provided on both sides (the upper and lower sides in FIG. 1) in a width-wise direction of a metal strip. However, a supporting rib may equally be provided on only one side of the metal strip.

(2) Further, in the first embodiment, the seats 19 may be formed so as to be of the same length as the strengthening ribs 22. This will further increase the bending strength of the foot members 14,15.

We claim:

1. A battery terminal connector suitable for connection to a substantially circular battery post, the connector being formed from a strip of conductive material and including a mid portion adapted to fit the post and arms extending from said mid portion, said arms being movable together so as to render said mid portion substantially circular and thereby clamp the connector to the post, wherein said connector is further provided with a strengthening member which extends along at least one of the arms and only partially along the mid portion to define a bending region on the mid portion without the strengthening member.

2. A battery terminal connector according to claim 1 wherein the strengthening member comprises a rib in the strip.

3. A battery terminal connector according to claim 1 wherein the strengthening member comprises a flanged edge of the strip.

4. A battery terminal connector according to claim 1 wherein said arms have apertures which are aligned in use and which are movable together by a screw threaded fastener passing through said apertures, and the strengthening member is adapted to prevent the head of a screw threaded fastener from rotating by abutment therewith.

5. A battery terminal connector according to claim 4 wherein strengthening members are provided on either side of said apertures.

6. A battery terminal connector according to claim 1 wherein a strengthening member extends from each arm along a part of the mid portion to define the preferred bending region between said arms.

7. A battery terminal connector according to claim 6 wherein said preferred bending region is provided with a surface formation adapted to engage with the battery post, in use.

8. A battery terminal connector according to claim 7 wherein the surface formation comprises a plurality of recesses perpendicular to the longitudinal edges of the strip.

9. A battery terminal connector according to claim 7 wherein the surface formation comprises a plurality of ribs perpendicular to the longitudinal edges of the strip.

10. A battery terminal connector according to claim 7 wherein the surface formation comprises a plurality of blind grooves perpendicular to the longitudinal edges of the strip.

* * * * *